US009050823B2

(12) United States Patent
Ratjen

(10) Patent No.: US 9,050,823 B2
(45) Date of Patent: Jun. 9, 2015

(54) METHOD FOR PRODUCING A PRINTING IMAGE MADE UP OF SECTIONS ON A MATERIAL TO BE PRINTED USING TWO INKJET PRINTING HEADS

(71) Applicant: Heidelberger Druckmaschinen AG, Heidelberg (DE)

(72) Inventor: Hans-Juergen Ratjen, Bad Bramstedt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/196,043

(22) Filed: Mar. 4, 2014

(65) Prior Publication Data

US 2014/0247300 A1 Sep. 4, 2014

(30) Foreign Application Priority Data

Mar. 4, 2013 (DE) ..... 10 2013 003 689

(51) Int. Cl.

| | |
|---|---|
| ***B41J 2/21*** | (2006.01) |
| ***B41J 2/515*** | (2006.01) |
| ***B41J 3/54*** | (2006.01) |
| ***B41J 25/00*** | (2006.01) |

(52) U.S. Cl.

CPC ..... *B41J 2/2135* (2013.01); *B41J 2/2146* (2013.01); *B41J 2/515* (2013.01); *B41J 3/54* (2013.01); *B41J 25/001* (2013.01)

(58) Field of Classification Search

CPC ..... B41J 2/2135; B41J 2/2128; B41J 2/0458; B41J 2/04541; B41J 2/2132

See application file for complete search history.

(56) References Cited

U.S. PATENT DOCUMENTS

| | | | | |
|---|---|---|---|---|
| 5,428,375 | A | 6/1995 | Simon et al. | |
| 6,746,103 | B2 * | 6/2004 | Tanuma | 347/40 |
| 7,003,161 | B2 * | 2/2006 | Tessadro | 382/199 |
| 7,955,456 | B2 | 6/2011 | Fischer et al. | |

(Continued)

FOREIGN PATENT DOCUMENTS

| | | | |
|---|---|---|---|
| DE | 102012202214 | A1 | 8/2012 |
| EP | 1293344 | A1 | 3/2003 |

(Continued)

OTHER PUBLICATIONS

Search Report of the German Patent and Trademark Office, Dated Nov. 21, 2013.

*Primary Examiner* — Manish S Shah
*Assistant Examiner* — Jeremy Delozier
(74) *Attorney, Agent, or Firm* — Laurence A. Greenberg; Werner H. Stemer; Ralph E. Locher

(57) ABSTRACT

A method produces a printing image formed of sections on a material using two inkjet printing heads. The printing image has first and second printing image sections meeting at a y coordinate Y1. The method includes choosing a data stripe extending in the x direction having a width about the location Y1, and examining the data in the selected stripe for a data field of the extent dx in the x direction and dy in the y direction, in which edge detection is possible. The data field is selected and the x coordinate x1 and the y coordinate y1 of the data field are captured. The printing image is then produced. An image of a measurement field correlated to the data field is recorded. The image is recorded, and edge detection is carried out. The image is corrected when an edge is detected.

13 Claims, 1 Drawing Sheet

(56) References Cited

U.S. PATENT DOCUMENTS

| | | | |
|---|---|---|---|
| 8,393,709 | B2 | 3/2013 | Enge |
| 8,585,173 | B2 | 11/2013 | Mizes et al. |
| 2004/0183603 | A1 | 9/2004 | Ma et al. |
| 2005/0183603 | A1 | 8/2005 | Trelewicz et al. |
| 2012/0206531 | A1 * | 8/2012 | Mizes et al. ..... 347/19 |

FOREIGN PATENT DOCUMENTS

| | | | |
|---|---|---|---|
| JP | 2002052757 | A1 | 2/2002 |
| WO | 2011011038 | A1 | 1/2011 |

* cited by examiner

METHOD FOR PRODUCING A PRINTING IMAGE MADE UP OF SECTIONS ON A MATERIAL TO BE PRINTED USING TWO INKJET PRINTING HEADS

CROSS-REFERENCE TO RELATED APPLICATION

This application claims the priority, under 35 U.S.C. §119, of German application DE 10 2013 003 689.5, filed Mar. 4, 2013; the prior application is herewith incorporated by reference in its entirety.

BACKGROUND OF THE INVENTION

Field of the Invention

The invention lies in the technical field of printing using inkjet printing heads.

The known prior art in this technical field includes for example U.S. Pat. No. 7,955,456 B2, which discloses inkjet printing of blister packaging. The latter have a substantially two-dimensional sealing film to be printed and are conveyed linearly. Despite high production rates, conveying and printing is therefore usually possible without difficulty. What is much more difficult is the printing of three-dimensional shaped bodies having outer surfaces that are curved in space. In both cases, it may additionally be necessary to print regions which are wider than the width of an individual printing head. For printing packaging, such as for example bottles in bottling plants, inkjet printing systems are increasingly used. Individual printing heads or modules of such systems have here for example a width of approximately 50 to approximately 100 mm, depending on the type and manufacturer. Wider printing systems are therefore constructed by way of a number of individual modules by joining them together (what is referred to as "stitching") to achieve the necessary printing width, with abutments being unavoidable.

At these abutments, the individual modules (for example Xaar 1001) must be aligned with respect to one another (x, y angle) such that, during printing, the joining from the modules does not become visible as stripes in the printing image: overlapping or under lapping of the modules presents itself as undesired dark (too much ink) or bright stripes (not enough ink). The alignment should be carried out both directly after final installation and after each service including interchange of a module, so as to ensure a discontinuity-free printing image. Such alignment may furthermore also be necessary during operation if the register changes for example on account of thermal influences.

The resolution of modules currently available on the market is between 300 and 600 dpi, which corresponds to 80 to 40 μm. In order to avoid joining from a module being visible, any incorrect positioning of a printed line in the printing image in the transition region ("stitching" region) between two modules must not be more than half a line width (in the above examples: 40 or 20 μm). Such position errors can certainly occur on account of temperature influences during operation.

The known prior art furthermore includes international patent disclosure WO 2011/011038 A1, corresponding to U.S. Pat. No. 8,393,709, which discloses a method for preventing printing errors, in which initially a test image is printed during a setup, a "stitch error" is measured in the test image, and the printing heads are driven using correspondingly corrected data (what is known as "masked" data), that is to say the correction takes place at data level. This includes the understanding that dark places in the printing image are more susceptible to visible errors than light places, for which reason correction is, under certain circumstances, carried out in dependence on the image content, and for which reason LUT architecture is chosen, in which a wide variety of weighting factors can be set (for example including multipliers which take into account different speeds of the material to be printed). During the subsequent production, the printing image is monitored and, if the print density changes, the strength of the masking is dynamically matched. One problem when using test images can be that—depending on the stability of the system—possibly a plurality of test images must be printed one after another (iteratively) and measured, which takes time and produces wastepaper. The document does not mention mechanical displacement of the heads. Importantly, it does not describe that it could be possible to only use the printing image or its evaluation for the correction and that printing of test images could thus be avoided.

SUMMARY OF THE INVENTION

Against this background, it is the object of the present invention to provide a method which is improved with respect to the prior art, which method makes it possible to avoid losses in quality during printing using a plurality of inkjet printing heads owing to what is known as stitching errors (errors caused by joining together a plurality of printing heads, with the latter having too much or too little spacing) and, in the process, to dispense with the prior, possibly iterative printing of test images and their measurements.

The method according to the invention produces a printing image made up of sections on a material to be printed using two inkjet printing heads. The printing image in the y direction is made up of a first and a second printing image section substantially at a y coordinate Y1, and wherein a first printing head produces the first section and a second printing head produces the second section. The method includes: choosing a data stripe extending in the x direction having the width DY about the location Y1 in the data of the printing image, examining the data of the printing image in the selected stripe for the presence of a data field of the extent dx in the x direction and dy in the y direction, in which edge detection is possible, selecting the data field and capturing the x coordinate x1 and the y coordinate y1 of the data field, producing the printing image, and recording an image of a measurement field correlated to the data field on the material to be printed using a camera. The image is recorded at the location x1, y1 and has at least the size dx*dy. An edge detection is carried out in the data of the image of the measurement field. The y position of at least one of the two printing heads is corrected in case an edge is detected.

The method according to the invention advantageously makes it possible to avoid quality losses during printing using a plurality of inkjet printing heads owing to what is known as stitching errors and, in the process, to dispense with the prior, possibly iterative printing of test images and their measurement. The method therefore requires no additional printouts and data here for, but proceeds directly with the printing image or the information or data obtained there from. Complicated creation of appropriate test images and printing thereof and the associated undesired production of wastepaper can therefore be dispensed with. Instead, the method according to the invention finds matching locations in the real printing data on the material to be printed for a camera inspection. The method can be carried out very quickly, because it can be carried out primarily in a computer-based fashion, and the printing head positioning can be corrected at a corresponding speed. In addition, such correction can be carried out during printing, such that even minor misalignments are detectable and correctable at any time. For this reason, the method is also perfectly suitable for closed-loop control.

One preferred further development of the method according to the invention can be characterized in that a Sobel filter (synonym: Sobel operator) is used in the edge detection. The Sobel filter calculates the first derivation of the grayscale profile, with smoothing being carried out at the same time orthogonally to the derivation direction. The algorithm which is used as the basis in the process uses convolution using a matrix, which produces a gradient image from the original image, which gradient image shows high frequencies in the original image with gray values. The regions of greatest intensity are the locations where the brightness of the original image has changed the most and thus where the greatest brightness edges are located. Therefore, another threshold value comparison is carried out usually after convolution with the Sobel operator.

One preferred further development of the method according to the invention can be characterized in that, when examining the data of the printing image, an examination is carried out as to whether a data field with an average color density of approximately 50% to approximately 70% is present. Lower or higher values (approximately 30% to approximately 90%) are also utilizable, although not preferred. Even an average color density of 100% can still be used: although overlap in a measurement field with 100% color density cannot be determined, an underlap becomes even more strongly visible on account of the resulting bright line. Average color density values between approximately 50% to approximately 70% are therefore preferred, since both overlap and under lap can be detected reliably.

One preferred further development of the method according to the invention can be characterized in that, when examining the data of the printing image, an examination is carried out as to whether the data field has a homogenous, i.e. uniform (not heterogeneous or too strongly inhomogeneous) color density. In such a data field, an overlap and an under lap would result in easily detectable dark or light lines including their detectable edges.

One preferred further development of the method according to the invention can be characterized in that, when examining the data of the printing image, an examination is carried out as to whether the data field has no or only a minor to a maximum average profile of the color density or of the corresponding gray value, in particular a profile for which the following is true: the increase of the color density profile or of the corresponding gray value profile of the printing image in the field (within the data stripe) is between approximately 0 (no profile) and approximately 0.5 (region of the maximum average profile), preferably between approximately 0.05 and approximately 0.25 (region of the average profile), and particularly preferably approximately 0.1.

One preferred further development of the method according to the invention can be characterized in that selecting the data stripe, examining and selecting the data field are carried out before printing begins, and the coordinates of the data field or of the correlated measurement field which are captured in the process are stored in a data memory for recording the image. In such a process, often referred to as "preflight", the data required for the inspection (image recording and image evaluation) can be gathered by a computer. The calculation time plays no large role in this case since the calculations are substantially complete before printing and inspection begin.

One preferred further development of the method according to the invention can be characterized in that the method is carried out as a closed-loop control, by recording an image a plurality of times, carrying out edge detection and carrying out a printing head correction in a control loop. In this way it is possible to detect and correct even small and/or slowly forming or changing misalignments without substantial delay, such that all printing images of a print job with a large number of identical or changing printing images are of excellent quality.

A preferred further development of the method according to the invention can be characterized in that, when producing multi-color printing images, the method is carried out separately for at least two color separations. Each color separation, as it is known, C, M, Y, and K is preferably treated according to the invention separately in the known four-color print with the colors cyan, magenta, yellow and black (CMYK) and in the process subjected to any correction that may be necessary, preferably as part of a closed-loop control.

One preferred further development of the method according to the invention can be characterized in that the position correction of the printing head is carried out by motor-driven adjustment. A quickly reacting actuator is preferably used for this such that necessary position corrections of the printing heads can be carried out substantially without time delay and error-containing printing images can therefore substantially be avoided.

The above-mentioned method according to the invention can also be described by the following synonymous main claim or its feature combinations: a method for inkjet printing, wherein a camera records an image of a measurement field on the material to be printed, wherein a computer determines any misalignment of a printing head by way of image processing, and the lateral position of the printing head is controlled and in the process adjusted by way of a motor.

Other features which are considered as characteristic for the invention are set forth in the appended claims.

Although the invention is illustrated and described herein as embodied in a method for producing a printing image made up of sections on a material to be printed using two inkjet printing heads, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
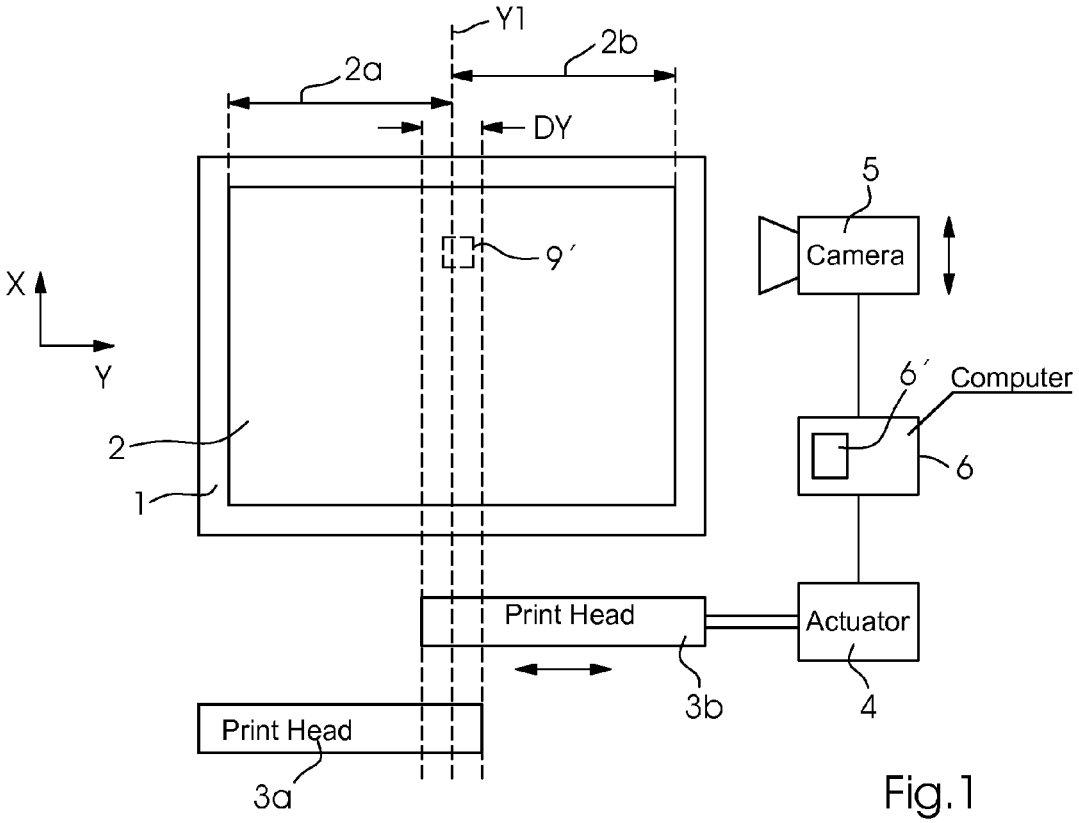
FIG. 1 is a schematic illustration of a preferred exemplary embodiment of a printing system during a performance of a preferred exemplary embodiment of a method according to the invention.

Referring now to the figures of the drawing in detail and first, particularly, to FIG. 1 thereof, there is shown a material 1 to be printed having a printable region 2, which is made up of two sections 2*a* and 2*b*. Section 2*a* is printed by an inkjet printing head 3*a*, and section 2*b* by an inkjet printing head 3*b*. In a y direction, the two sections adjoin at the location Y1. The two printing heads overlap in a region DY, which can also be referred to as a stitching region. Owing to imprecise positioning (misalignment) of the printing heads in the lateral y direction, undesired light (the spacing between the printing heads is too great) or dark lines (overlap of printing heads is too great) can occur in this region in the printing image. A printer that is freshly installed at the customer's premises is initially aligned with a high degree of precision, but later, owing to, among others, thermal influences, very fine and only slowly changing misalignments can occur which, despite their minor deviations from the predetermined values, still result in visible and thus disturbing effects (for example the lines mentioned) in the printing image. The invention seeks to avoid such lines.

The printing head 3*b* is displaceable in the y direction. An actuator 4 is provided as drive for the displacement. A camera 5, which is displaceable in the x direction, is aimed at the material 1 to be printed and can record images 11 (see FIG. 3) of regions of the material to be printed. The images are made available to a computer 6 of a control device.

Figure 2:
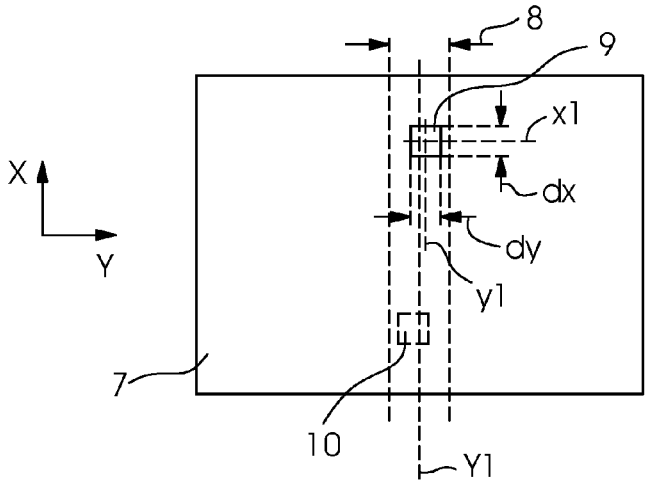
FIG. 2 is a schematic illustration of a printing image or of its representation in the form of an x-y data set.

FIG. 2 shows the printing image 7, which is intended to be printed in the printable region 2. The printing image is available as a file containing an x-y matrix of printing image data, for example what is known as a bitmap file. In the data matrix, a stripe 8 extending in the x direction is selected, which in terms of its width substantially corresponds to the region DY and is located preferably symmetrically with respect to the y position of the location Y1. The region, or the printing image data located therein, is selected because the undesired light or dark lines are expected therein. It is also possible to select a wider stripe, in which the stripe 8 is located. The selected data in the stripe are subsequently examined.

The selected printing image data are examined as follows: in the computer 6, and using a corresponding program, an examination is carried out as to whether a field 9 of the size or extent dx in the x direction and dy in the y direction is present at any desired location (with the coordinates x1 and y1) in the stripe 8, which field can serve as the measurement field 9' (see FIG. 1) on the material 1 to be printed. In the process, the program examines the data in the field 9 to determine whether they are suitable for edge detection on the basis of known image processing steps, for example for the application of a digital edge filter, such as what is known as a Sobel filter. The field 9 is suitable, for example, if it has a substantially homogenous gray value. "Gray value" can in this context also be understood to mean a single color value of the color values C, M, Y or K during conventional production of four-color prints. In CMYK printing images, the examination for the presence of a field is consequently carried out separately for each color separation. In fields with a very inhomogenous gray value, or in fields which have for example lettering, owing to the high spatial frequencies of the grayscale profile, edge detection alone would not suffice to detect an existing line. Therefore, such fields are not selected.

The field 9 is suitable in particular if the following three criteria are met:

A) It has an average color density of approximately 50% to approximately 70%.

B) It has a substantially homogenous color density profile or a corresponding grayscale profile or an only minor to a maximum average color density profile or a corresponding grayscale profile which is not detected by the edge filter used owing to the spatial frequency of the profile being too low. For the profile, the following applies: the increase of the color density profile or of the corresponding grayscale profile of the printing image in the field 9 (within the data stripe 8) is between approximately 0 (no profile) and approximately 0.5 (region of the maximum average profile), preferably between approximately 0.05 and approximately 0.25 (region of the average profile), and particularly preferably approximately 0.1.

C) It must have such a position x1, y1 and extent dx*dy that it is located completely within the stripe 8 and it must be sufficiently large for the digital filter in its full filter size to be pushed over the location Y1. Example 1 (ideal case): the Sobel filter has a size of 5*5 pixels, and each pixel has a size of 10*10 μm. For DY, this then results in 2*5*10 μm=100 μm minimum width. Example 2 (practical example): the position of the abutment already has an inaccuracy of approximately 100 μm. Added to this are inaccuracies caused by the distance between the camera used and the location of printing and the location of drying of the printing ink, or caused by thermal effects in the mechanical holders of the printing heads and of the camera. The width of the stripe DY will therefore in practice be approximately 2 mm or more. A camera with an image circle of 10 mm can capture such a stripe of 2 mm width without difficulty, the stripe could even move laterally back and forth by several millimeters. The Sobel filter has a size of 5*5 pixels, and each pixel has a size of 10*10 μm. The stripe 8 has a width of approximately 2 mm. The Sobel filter can, in this practical example, thus be displaced in its full width within the stripe.

If such a field 9 is found in the stripe 8, the field is selected for the continued performance of the method according to the invention and thus becomes a measurement field 9'. If a plurality of usable fields, for example the fields 9 and 10, are found, it is possible to select among them that field which is most useful, for example the field which best meets the above-mentioned criteria A to C. The coordinates (x coordinate x1 and y coordinate y1) of the selected field are captured and are thus available for the further steps.

Selecting the data stripe, examining and selecting the data field can preferably be carried out in this case before printing begins, and the coordinates x1 and y1 of the data field 9 or of the correlated measurement field 9' which are captured in the process can be stored in a data memory 6' for recording the image 11 using the camera 5.

The camera 5 then records an image 11 (see FIG. 3) of the measurement field 9' (see FIG. 1). To this end, the camera can be brought into a position, for example by way of displacement, which allows the image to be recorded. However, if the camera is already positioned such that the stripe with the width DY runs along below it, the camera only needs to be activated in the instance at which the measurement field passes into the recording region of the camera. To this end, the coordinates x1 and y1 of the selected measurement field can be used, which, with knowledge of the dimensions of the material to be printed or of the position of the printing image 2 on the material to be printed and of the conveyance speed of the material 1 to be printed, permit calculation of the trigger time of the camera. The recorded image should have at least the size dx*dy, such that edge detection can be carried out in the image.

The data of the recorded image 11, for example as bitmap, are made available to the computer 5. The computer, or a program executed thereon, then carries out edge detection, wherein for example the Sobel filter already mentioned above is used.

If at least one printing head is considerably misaligned, the edge detection will yield an edge in the data of the image 11 of the measurement field 9' as the result. It is also possible here to carry out a threshold value comparison: if a given threshold is exceeded, undesired overlap of the printing heads would be detected. If a given, different threshold is undershot, an undesired under lap, that is to say a spacing between the printing heads which is too great would be detected. Depending on the present situation (overlap or under lap), the direction of the displacement by motor for at least one of the printing heads is determined.

Figure 3:
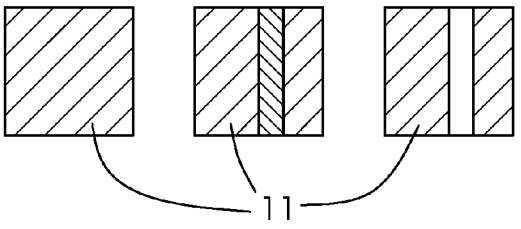
FIG. 3 is a schematic illustration of exemplary camera images.

FIG. 3 shows, by way of example, three such recorded images 11 of the selected measurement field 9'. The left-hand image shows that the two printing heads 3*a* and 3*b* are aligned precisely with respect to one another, and therefore produce no visible line at the abutment location Y1 of the printing heads. The image therefore shows a homogenous gray value. The middle image shows that the two printing heads overlap too much and therefore produce a dark line at the abutment location Y1. The right-hand image shows the case where the two printing heads are too far removed from one another and therefore produce a light line in the printing image at the abutment location Y1.

When the edge detection that is performed detects one of the two cases shown in the middle or the right-hand image of FIG. 3, the computer 6 will transmit a signal to the actuator 4, which carries out a correcting adjustment of the printing head 3*b*. Alternatively, it is also possible for the printing head 3*a* to be adjusted or for both printing heads to be adjusted. The adjustment takes place in any case in the y direction, and the value of the adjustment correlates to the width of the detected line.

Since the adjustment of the printing head 3*b* results in a change in the printing image 2, and the width of the lines shown in FIG. 3 decreases in the process, a repeat recording of an image 11 of the measurement field 9' in one of the subsequent prints and its repeat evaluation using edge detection can be used to form a closed control loop. Within the context of the closed-loop control or of the described sampling closed-loop control system, a measurement field 9' is selected repeatedly or even continuously and an image of it is recorded, edge detection in the data of the image is carried out, and, if an edge is present, a compensating adjustment of the printing head is initiated. The measurement field can also be selected only once, preferably before printing begins, and then be used repeatedly for monitoring purposes during the closed-loop control. In the case of identical prints, a fixed measurement field is advantageous, but in differing prints, it might be advantageous for the measurement field to be determined anew for each different print. The control variable used is thus finally the distance of the last nozzle (or nozzle row) of a first printing head from the first nozzle (or nozzle row) of a second, adjacent printing head. The distance can be determined from the width of the (light or dark) line found during edge detection.

If CMYK images are printed, it is advantageous to carry out the described method separately for each color separation, that is to say for C, M, Y, and K, that is to say one data field 9 for each color separation, and to determine a measurement field 9' there from. The measurement fields for the various color separations do not necessarily have to have the same x-y coordinates, that is to say the camera 5 can record images 11 of the printing image on the material 1 to be printed that are located at different locations. Edge detection can in that case likewise be carried out separately for each color separation, and the results, that is to say the closed-loop control values for the adjustment by motor, are supplied to the individual printing heads for the different colors CMYK. It may therefore be the case that only one color separation, a plurality of color separations or even all color separations and the associated printing heads are subject to correction. In order to make recordings of the various color separations, the camera can be equipped with corresponding, preferably automatically interchangeable color filters, or provision may be made for use of corresponding, preferably automatically interchanging illumination device. If no data fields 9 usable for edge detection can be determined in a stripe 8 for any of the color separations, the relevant two printing heads 3*a* and 3*b* can be taken out of the closed-loop control, because in that case it should be expected that misalignments of the relevant printing heads do not result in a visible disturbance caused by the formation of lines. If the same is true for all abutment locations of printing heads in a color separation, the entire color separation may be removed from the closed-loop control.

The invention claimed is:

1. A method for producing a printing image made up of sections on a material to be printed using two inkjet printing heads, the printing image in a y direction is made up of a first and a second printing image section meeting at a y coordinate location Y1, and a first printing head producing the first section and a second printing head producing the second section, which comprises the steps of:

choosing a data stripe extending in an x direction and having a width DY about the location Y1 in data of the printing image;

examining the data of the printing image in the data stripe for a presence of a data field of an extent dx in the x direction and dy in the y direction, in which edge detection is possible, selecting the data field and capturing an x coordinate x1 and a y coordinate y1 of the data field and when examining the data of the printing image, carrying out an examination as to whether the data field has a homogenous color density;

producing the printing image;

recording an image of a measurement field correlated to the data field on the material to be printed using a camera, wherein the image recorded is at a location x1, y1 and has at least a size dx*dy;

carrying out the edge detection in the data of the image of the measurement field; and correcting a y position of at least one of the first and second printing heads in case an edge is detected.

2. The method according to claim 1, which further comprises providing a Sobel filter for assisting in the edge detection.

3. The method according to claim 1, which further comprises carrying out at least one threshold value comparison during the edge detection.

4. The method according to claim 1, wherein when examining the data of the printing image, carrying out an examination as to whether the data field with an average color density of approximately 50% to approximately 70% is present.

5. The method according to claim 1, wherein the printing image is an actual final printed image and is not a test image or a test pattern.

6. The method according to claim 1, wherein when examining the data of the printing image, carrying out an examination as to whether the data field has no or only a minor to a maximum average profile of a color density or of a corresponding gray value.

7. The method according to claim 1, which further comprises:

carrying out the choosing of the data stripe and the examining and the selecting of the data field before printing begins; and storing coordinates of the data field or of a correlated measurement field which are captured a data memory for recording the image.

8. The method according to claim 1, which further comprises carrying out the method as a closed-loop control, by recording the image a plurality of times, carrying out the edge detection and carrying out the printing head correction in a control loop.

9. The method according to claim 1, wherein when producing multi-color printing images, carrying out the method separately for at least two color separations.

10. The method according to claim 1, which further comprises carrying out a position correction of one of the first and second printing heads by a motor-driven adjustment.

11. A method for producing a printing image made up of sections on a material to be printed using two inkjet printing heads, the printing image in a y direction is made up of a first and a second printing image section meeting at a y coordinate location Y1, and a first printing head producing the first section and a second printing head producing the second section, which comprises the steps of:

choosing a data stripe extending in an x direction and having a width DY about the location Y1 in data of the printing image;

examining the data of the printing image in the data stripe for a presence of a data field of an extent dx in the x direction and dy in the y direction, in which edge detection is possible, selecting the data field and capturing an x coordinate x1 and a y coordinate y1 of the data;

producing the printing image;

recording an image of a measurement field correlated to the data field on the material to be printed using a camera, wherein the image recorded is at a location x1, y1 and has at least a size dx*dy;

carrying out the edge detection in the data of the image of the measurement field;

correcting a y position of at least one of the first and second printing heads in case an edge is detected; and when examining the data of the printing image, carrying out an examination as to whether the data field has no or only a minor to a maximum average profile of a color density or of a corresponding gray value, in particular a profile for which the following is true: an increase of a color density profile or of a corresponding gray value profile of the printing image in the data field is between approximately 0 and approximately 0.5.

12. The method according to claim 11, wherein the increase of the color density profile or of the corresponding gray value profile of the printing image in the data field is between approximately 0.05 and approximately 0.25.

13. The method according to claim 11, wherein the increase of the color density profile or of the corresponding gray value profile of the printing image in the data field is between approximately 0.1.

* * * * *